US007238061B1

(12) United States Patent
Lin

(10) Patent No.: US 7,238,061 B1
(45) Date of Patent: Jul. 3, 2007

(54) VEHICLE LIGHTING SOURCE ADAPTER

(76) Inventor: Yu-Chu Lin, No. 477, Chung Shan N. Rd., Yung Kang City, Tainan Hsien (TW)

( * ) Notice: Subject to any disclaimer, the term of this patent is extended or adjusted under 35 U.S.C. 154(b) by 0 days.

(21) Appl. No.: 11/532,822

(22) Filed: Sep. 18, 2006

(51) Int. Cl.
*H01R 24/00* (2006.01)

(52) U.S. Cl. ..... 439/699.1; 439/619

(58) Field of Classification Search ..... 439/699.1, 439/619, 699.2
See application file for complete search history.

(56) References Cited

U.S. PATENT DOCUMENTS 5,036,248 A * 7/1991 McEwan et al. ..... 313/500
5,160,200 A * 11/1992 Cheselske ..... 362/249
5,160,201 A * 11/1992 Wrobel ..... 362/249
5,575,459 A * 11/1996 Anderson ..... 362/240
5,577,832 A * 11/1996 Lodhie ..... 362/249
5,655,830 A * 8/1997 Ruskouski ..... 362/240
5,669,703 A * 9/1997 Wheeler et al. ..... 362/249
5,726,535 A * 3/1998 Yan ..... 315/185 R
5,806,965 A * 9/1998 Deese ..... 362/249
5,947,588 A * 9/1999 Huang ..... 362/235
6,036,336 A * 3/2000 Wu ..... 362/249
6,220,722 B1 * 4/2001 Begemann ..... 362/231
6,227,679 B1 * 5/2001 Zhang et al. ..... 362/236
6,276,822 B1 * 8/2001 Bedrosian et al. ..... 362/545
6,338,647 B1 * 1/2002 Fernandez et al. ..... 439/490
6,357,902 B1 * 3/2002 Horowitz ..... 362/545
6,371,636 B1 * 4/2002 Wesson ..... 362/545
6,499,860 B2 * 12/2002 Begemann ..... 362/230
6,547,417 B2 * 4/2003 Lee ..... 362/249
6,580,228 B1 * 6/2003 Chen et al. ..... 315/185 R
6,595,656 B2 * 7/2003 Yoda ..... 362/187
6,598,996 B1 * 7/2003 Lodhie ..... 362/249
6,601,983 B1 * 8/2003 Runfola et al. ..... 362/545
6,621,222 B1 * 9/2003 Hong ..... 315/51
6,659,632 B2 * 12/2003 Chen ..... 362/545
6,786,625 B2 * 9/2004 Wesson ..... 362/545
6,791,840 B2 * 9/2004 Chun ..... 361/715
6,796,698 B2 * 9/2004 Sommers et al. ..... 362/555
6,827,469 B2 * 12/2004 Coushaine et al. ..... 362/294
6,860,628 B2 * 3/2005 Robertson et al. ..... 362/555
6,880,962 B2 * 4/2005 Coushaine et al. ..... 362/555
6,905,227 B2 * 6/2005 Wu ..... 362/240
6,948,829 B2 * 9/2005 Verdes et al. ..... 362/227
6,957,906 B2 * 10/2005 Coushaine et al. ..... 362/555
7,040,790 B2 * 5/2006 Lodhie et al. ..... 362/541
7,052,171 B1 * 5/2006 Lefebvre et al. ..... 362/649
7,086,767 B2 * 8/2006 Sidwell et al. ..... 362/545
7,101,208 B2 * 9/2006 Hsu ..... 439/225
7,111,972 B2 * 9/2006 Coushaine et al. ..... 362/625
7,114,830 B2 * 10/2006 Robertson et al. ..... 362/240
7,161,311 B2 * 1/2007 Mueller et al. ..... 315/294
2001/0026447 A1 * 10/2001 Herrera ..... 362/226
2002/0097586 A1 * 7/2002 Horowitz ..... 362/545

(Continued)

*Primary Examiner*—Ross Gushi
(74) *Attorney, Agent, or Firm*—WPAT, P.C.; Anthony King

(57) ABSTRACT

A vehicle lighting source adapter includes a holder, terminals, and cables connected to the terminals. The holder has its front end disposed with an insertion plate. The insertion plate includes an upper surface and a lower surface. Each of the upper and lower surfaces is disposed with connection channels and insertion blocks. Each connection channel includes a first fillister and a second fillister. A retainer is disposed to each fillister. Each terminal is inserted into and partially exposed form the first fillister and has its snap portion to be restricted by the retainer.

3 Claims, 3 Drawing Sheets

U.S. PATENT DOCUMENTS

2002/0117692 A1* 8/2002 Lin ..... 257/235
2004/0070519 A1* 4/2004 Wu et al. ..... 340/907
2005/0057187 A1* 3/2005 Catalano ..... 315/291
2005/0276063 A1* 12/2005 Coushaine et al. ..... 362/555
2007/0012997 A1* 1/2007 Chung et al. ..... 257/331

* cited by examiner

VEHICLE LIGHTING SOURCE ADAPTER

BACKGROUND OF THE INVENTION (a) Field of the Invention

The present invention relates to a vehicle lighting source adapter, and more particularly, to a holder having at its front end disposed with an insertion plate, and the insertion plate is disposed with connection channels and insertion blocks to receive insertion of terminals.

(b) Description of the Prior Art

Among those vehicle lighting fixtures generally available in the market, LED becomes the most popular today. However, the LED is not compatible with the conventional lamp holder and the vehicle lamp contacts must be revised.

An adapter of the prior art has a flat and straight metal terminal fixed to a holder while the holder is inserted into the lamp holder with the terminal from the lamp holder abutted to that from the holder in a fashion of local plane. Therefore, minute spacing does exist between the terminals due to the process allowances respectively of the adapter holder and the vehicle lamp holder. Consequently, there is the imprecise abutting between both terminals, leading further to a broken circuit due to poor contact.

SUMMARY OF THE INVENTION

The primary purpose of the present invention is to provide a vehicle lighting source adapter to solve the problem of broken circuit due to poor contact.

To achieve the purpose, the present invention includes a holder, terminals and cables. The holder has its front end disposed with an insertion plate. The insertion plate includes an upper surface and a lower surface. Each of the upper and lower surfaces is disposed with connection channels and insertion blocks. Each connection channel includes a first fillister and a second fillister. A retainer is disposed to each fillister. Each terminal is inserted into and partially exposed form the first fillister and has its snap portion to be restricted by the retainer.

Accordingly, when the second fillister of the connection channel of the holder receives the insertion by a terminal of a lamp holder from a vehicle, the terminal of the lamp holder and the snap portion of the terminal from the holder are abutted to each other to minimize the incidence of broken circuit due to poor contact.

DETAILED DESCRIPTION OF THE PREFERRED EMBODIMENTS

Figure 1:
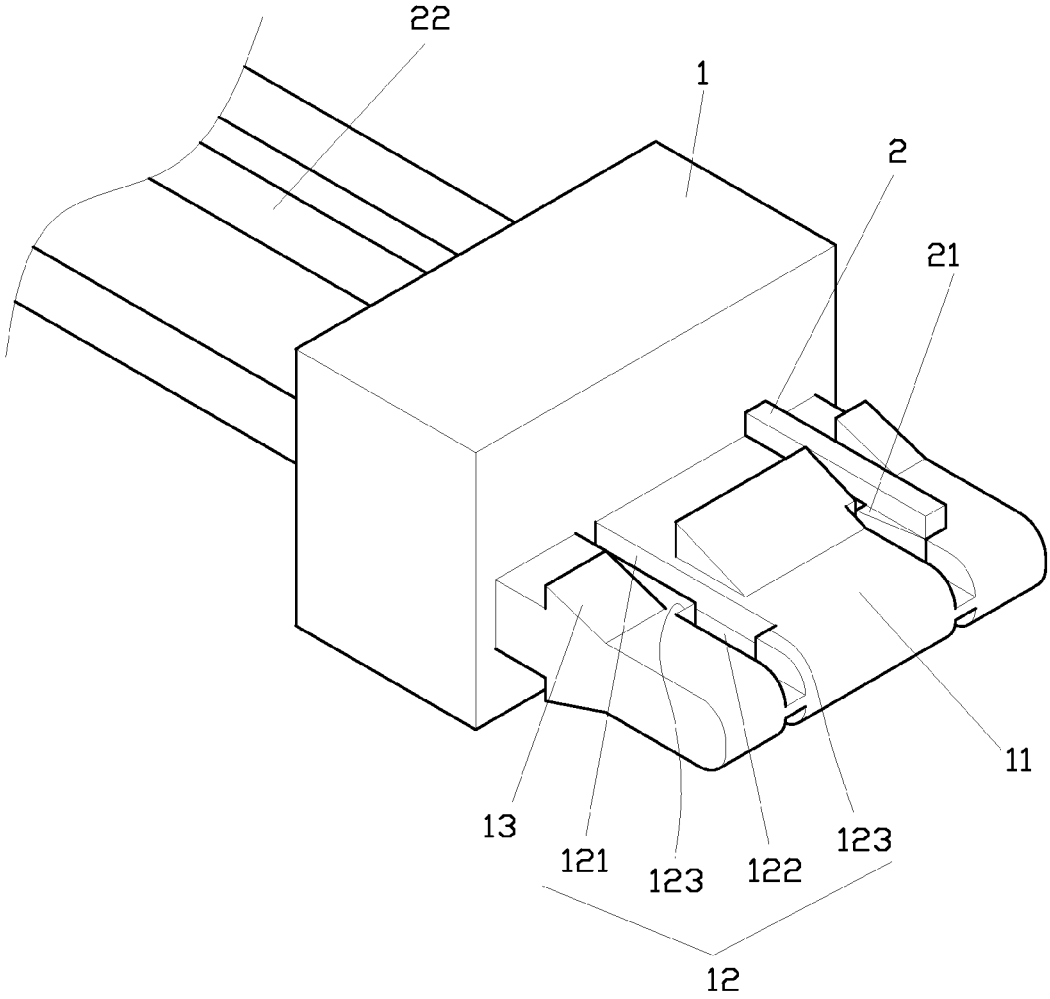
FIG. 1 is a perspective view of a preferred embodiment of the present invention.

Referring to FIG. 1, a preferred embodiment of the present invention includes a holder (1) and terminals (2).

The holder (1) has its front end disposed with an insertion plate (11). The insertion plate (11) includes an upper surface and a lower surface. Each of the upper surface and the lower surface of the insertion plate (11) is disposed with connection channels (12) and insertion blocks (13). Each connection channel (12) includes a first fillister (121) and a second fillister (122). The first and second fillisters (121, 122) are arranged in parallel with each other and partially connecting through each other. A retainer (123) is disposed to each fillister at where both fillisters are connected through. The retainer (123) is a shoulder portion. The insertion block (13) is inclined towards to its outer end.

Each terminal (2) is disposed with a snap portion (21) and the snap portion (21) is inclined towards to its outer end. A cable (22) is connected to the back of each terminal (2). The terminal (2) is inserted into and partially exposed from the first fillister (121) and the snap portion (21) is restricted by the retainer (123).

Figure 2:
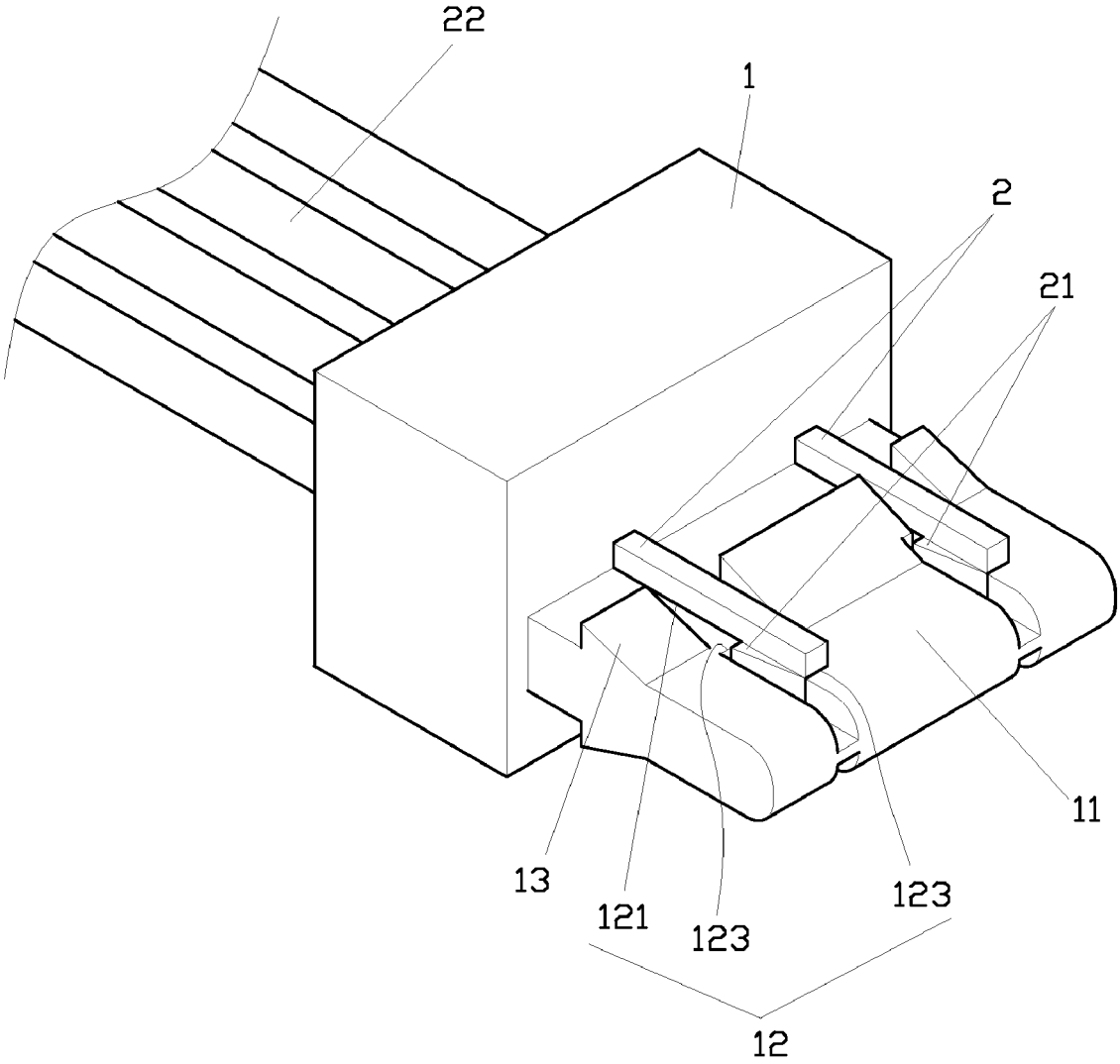
FIG. 2 is a perspective view of another preferred embodiment of the present invention.

As illustrated in FIG. 1, three terminals (2) are disposed to the holder (1) [only one terminal is visible while the other two terminals beneath the insertion plate (11) are blocked out of sight]. Each terminal (2) at its back is connected with the cable (22). In another preferred embodiment of the present invention as illustrated in FIG. 2, four terminals (2) are provided to the holder (1) [only two terminals are visible while the other two beneath the insertion plate (11) are blocked out of sight]. Each terminal (2) at its back is connected with the cable (22). Both preferred embodiments feature the identical construction with the only difference in that one more terminal (2) is disposed to another preferred embodiment illustrated in FIG. 2. Providing only two terminals to the holder (1) is also feasible with both terminals (2) either provided on one side or respectively on both sides of the insertion plate (11).

Figure 3:
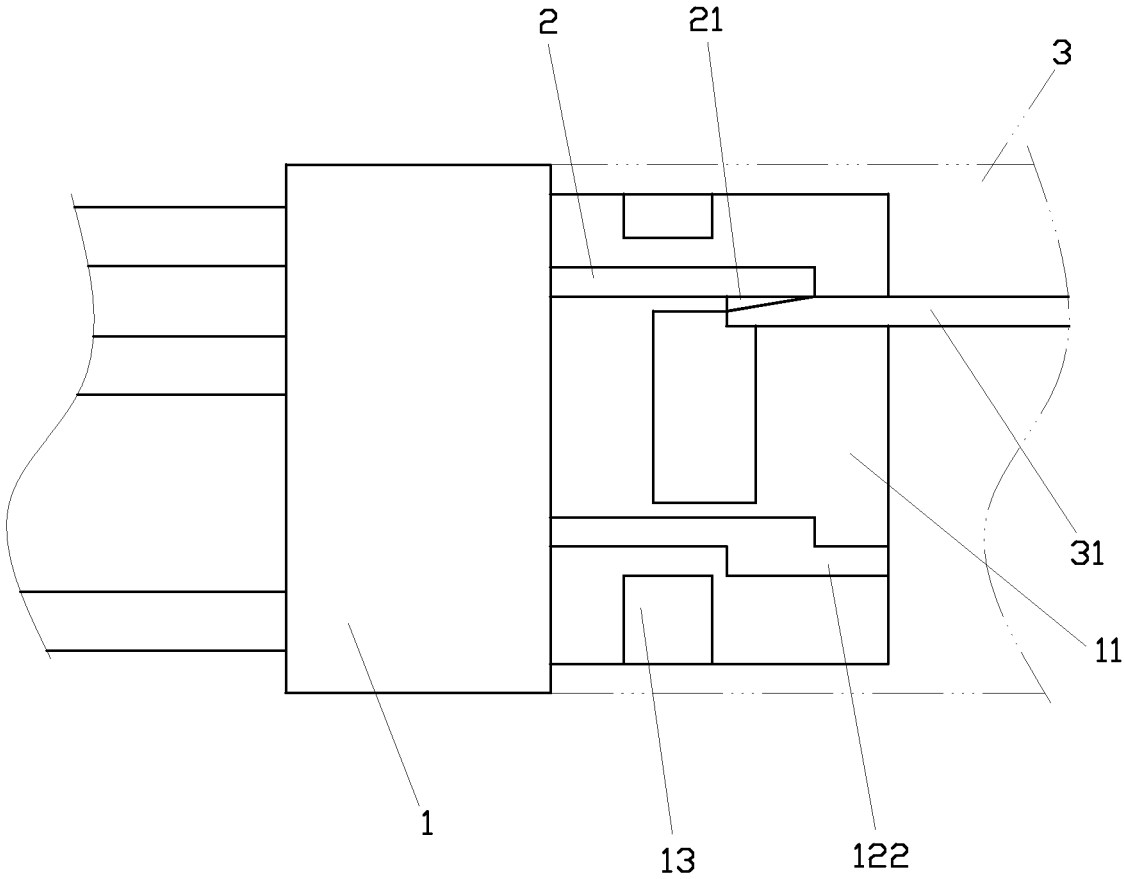
FIG. 3 is a schematic view showing that the present invention is inserted to a lamp holder.

In practice, as illustrated in FIG. 3, the insertion plate (11) of the holder (1) is inserted into a lamp holder (3) of a vehicle. The insertion blocks (13) and the snap portions (21) are inclined towards their outer ends respectively to facilitate the insertion of the lamp holder (3) and its terminals (31). Meanwhile, the lamp holder (3) is prevented from escaping due to inverse locking executed by the insertion blocks (13) of the insertion plate (11). The second fillister (122) of the holder (1) secures the terminal (31) of the lamp holder (3) in position. Both positive and negative poles of the terminal (31) are restricted by the second fillister (122) of the holder (1) to force the terminal (31) must be held against by the snap portion (21) of the terminal (2) thus to realize tight contact with the terminal (2) and thus the electric connection to effectively minimize the incidence of broken circuit due to poor contact. Furthermore, the lamp holder (3) is prevented from displacement through the tight insertion executed by the insertion block (13).

What is claimed is:

1. A vehicle lighting source adapter, comprising:

a holder, the holder having its front end disposed with an insertion plate, the insertion plate including an upper surface and a lower surface, each of the upper and lower surfaces being disposed with connection channels and insertion blocks, each connection channel including a first fillister and a second fillister; both the first and second fillisters being arranged in parallel with each other and partially connecting through each other, a retainer being disposed to each of the first and second fillisters at where both the first and second fillisters are connected through; each of the insertion blocks being inclined towards to its outer end;

terminals, each terminal being inserted into the first fillister and disposed with a snap portion, the snap portion being inclined towards its outer end and restricted by the retainer; and cables, each cable being connected to a relative terminal.

2. The vehicle lighting source adapter as claimed in claim 1, wherein the retainers of the first fillister and the second fillister are made in a form of a shoulder.

3. The vehicle lighting source adapter as claimed in claim 1, wherein each of the terminals is inserted into and partially exposed from the first fillister.

* * * * *